US005659868A

United States Patent [19]

Fromm et al.

[11] Patent Number: 5,659,868

[45] Date of Patent: Aug. 19, 1997

[54] PRESSURE ROLL HAVING A FLAT SHAFT FOR USE IN A HEAT AND PRESSURE FUSER APPARATUS

[75] Inventors: Paul M. Fromm, Rochester; Edward C. Hanzlik, Fairport, both of N.Y.

[73] Assignee: Xerox Corporation, Stamford, Conn.

[21] Appl. No.: 570,222

[22] Filed: Dec. 11, 1995

[51] Int. Cl.[6] ..... G03G 15/20

[52] U.S. Cl. ..... 399/331; 100/176; 399/339

[58] Field of Search ..... 355/282, 285, 355/289, 290, 295; 492/16, 18, 20, 46; 219/216, 469; 100/155 R, 162 B, 176; 384/565, 567, 549, 618, 619; 399/330, 331, 333, 338, 335

[56] References Cited

U.S. PATENT DOCUMENTS

| | | | |
|---|---|---|---|
| 2,898,662 | 8/1959 | Robertson | 100/162 B X |
| 4,041,752 | 8/1977 | Dolenc et al. | 100/162 B X |
| 4,357,743 | 11/1982 | Hefter et al. | 100/162 B X |
| 4,389,114 | 6/1983 | Westerman | 219/216 X |
| 4,577,747 | 3/1986 | Martin | 198/500 |
| 4,681,215 | 7/1987 | Martin | 198/843 |
| 4,691,421 | 9/1987 | Schiel | 100/155 R X |
| 4,709,571 | 12/1987 | Guttinger | 100/162 B X |
| 4,870,731 | 10/1989 | Yano | 492/16 |
| 4,872,246 | 10/1989 | Yano | 492/16 |
| 4,882,922 | 11/1989 | Dominque | 100/162 B X |
| 5,070,366 | 12/1991 | Tsuchiya | 355/295 X |
| 5,081,759 | 1/1992 | Schiel | 100/162 B X |
| 5,099,289 | 3/1992 | Kurotori et al. | 355/290 |
| 5,200,786 | 4/1993 | Fromm et al. | 355/284 |
| 5,308,307 | 5/1994 | Morel et al. | 492/16 X |

FOREIGN PATENT DOCUMENTS

| | | | |
|---|---|---|---|
| 775410 | 1/1968 | Canada | 492/16 |
| 97085 | 1/1964 | Denmark | 492/16 |

*Primary Examiner*—Matthew S. Smith

[57] ABSTRACT

A heat and pressure fuser apparatus including a heated fuser roller cooperating with a pressure or back-up roller to form a nip through which substrates carrying toner images pass with the images contacting the heated fuser roll. A non-rotating pressure roll shaft is fabricated from preplated sheet stock material to provide a low cost, light-weight shaft.

4 Claims, 4 Drawing Sheets

PRESSURE ROLL HAVING A FLAT SHAFT FOR USE IN A HEAT AND PRESSURE FUSER APPARATUS

BACKGROUND OF THE INVENTION

This invention relates to fusing toner images and more particularly to a heat and pressure roll fuser for fixing toner images to copy substrates.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

After the electrostatic latent image is recorded on the photoconductive surface, it is developed by bringing a developer material including toner particles into contact therewith to thereby form toner images on the photoconductive surface. The images are generally transferred to a support surface such as plain paper to which they may be permanently affixed by heating or by the application of pressure or a combination of both.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. As will be appreciated, in a machine where duplex images are created both rolls may be heated. In either case, one of the rolls is usually referred to as the fuser roll while the other is commonly referred to as a pressure or back-up roll.

Heretofore, the shafts utilized for the pressure roll of a heat and pressure fuser have been fabricated from bar stock having a cylindrical cross section. Such shafts are costly to manufacture. The high cost of manufacture of such shafts is attributable to the amount of material required and the turning and plating processes which the shaft undergoes during fabrication. Typical pressure roll shafts fabricated according to the prior art cost about $5.80.

BRIEF SUMMARY OF THE INVENTION

According to the present invention, a toner fusing pressure roll, is provided which lends itself to being used as a Customer Replaceable Unit (CRU) for use in an electrophotographic copying or printing machine.

The pressure roll of the present invention utilizes a shaft that is relatively flat with a rectangular cross section instead of a conventional round shaft.

The weight of the flat shaft according to the present invention is approximately 25% of a conventional round shaft of the prior art. Thus, it is substantially less costly than a conventional round shaft. For example, a round shaft fabricated according to the prior art for a specific fuser configuration costs about $5.80. On the other hand, a flat shaft fabricated according to the present invention for the aforementioned fuser configuration costs about $0.80. The substantial difference in cost is attributable to the use of less raw material for the flat shaft compared to the round shaft as well as the difference in the cost of the fabrication techniques employed for the two shafts. The round shaft requires relatively expensive turning and plating procedures while the flat shaft of the present invention is formed by a simple stamping technique using preplated flat sheet stock. The use of the flat preplated sheet stock obviates the need for the turning and plating procedures required when fabricating pressure roll shafts using round stock. Also, there is a significant cost advantage in using the flat sheet stock because the round bar stock costs three times as much as preplated flat sheet stock.

DETAILED DESCRIPTION OF THE PREFERRED EMBODIMENT OF THE INVENTION

Figure 5:
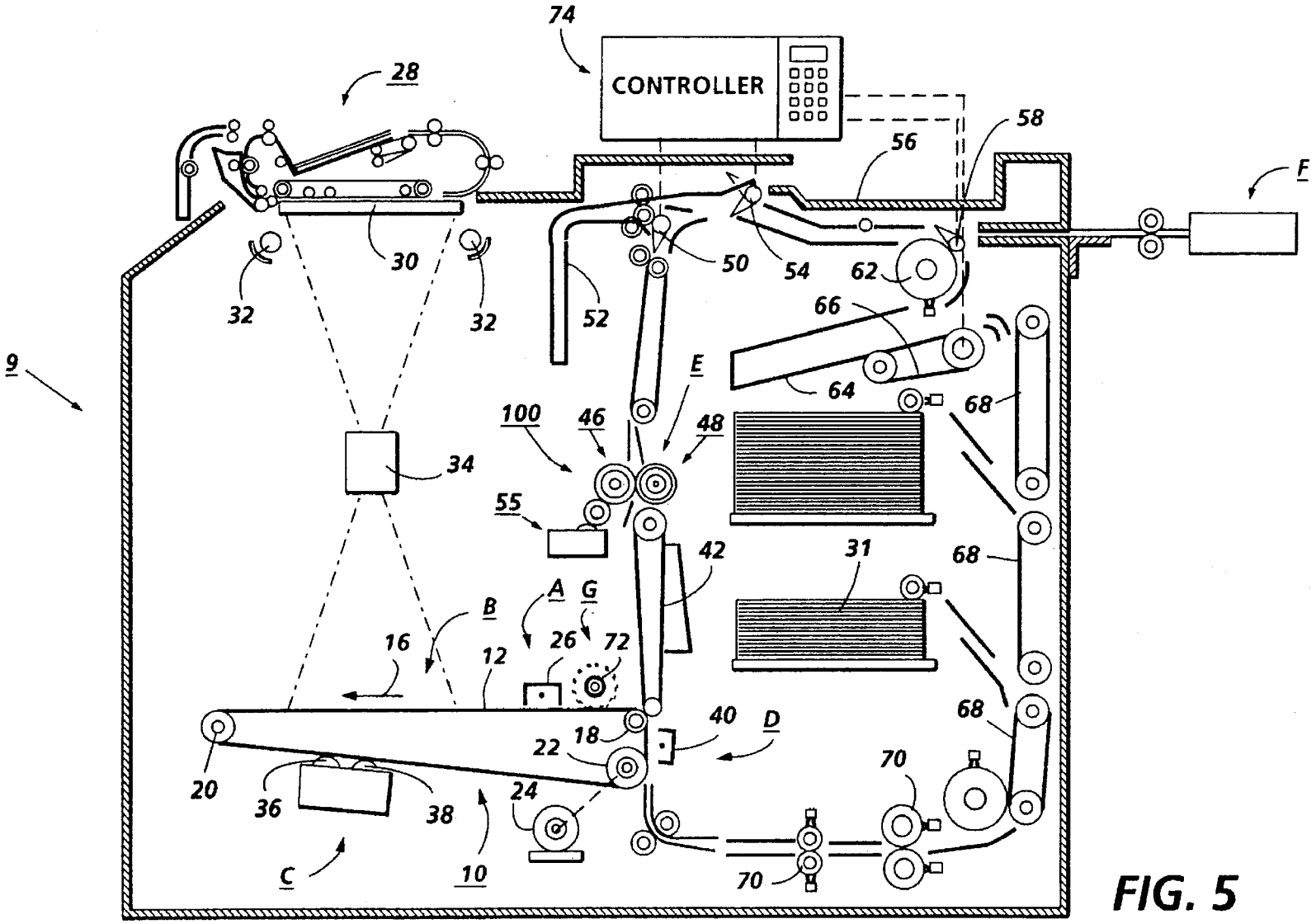
FIG. 5 is a schematic illustration of a printing apparatus in which the inventive features of the invention may be employed.

For a general understanding of the features of the present invention, reference is made to the drawings. In the drawings, like reference numerals have been used throughout to identify identical elements. FIG. 5 schematically depicts an electrophotographic printing machine 9 incorporating the features of the present invention therein.

Referring to FIG. 5 of the drawings, the electrophotographic printing machine employs a belt 10 having a photoconductive surface 12 deposited on a conductive substrate, not shown. Belt 10 moves in the direction of arrow 16 to advance successive portions of photoconductive surface sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive belt passes through a charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through an imaging station B. At imaging station B, a document handling unit, indicated generally by the reference numeral 28, is positioned over platen 30 of the printing machine. Document handling unit 28 sequentially feeds documents from a stack of documents placed by the operator faceup in a normal forward collated order in a document stacking and holding tray. A document feeder located below the tray forwards the bottom document in the stack to a pair of take-away rollers. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair.

Imaging of a document is achieved using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document.

Obviously, electronic imaging of page image information could be facilitated by a printing apparatus utilizing electrical imaging signals. The printing apparatus can be a digital copier including an input device such as a Raster Input Scanner (RIS) and a printer output device such as a Raster Output Scanner (ROS), or, a printer utilizing only a printer output device such as a ROS.

Thereafter, belt 10 advances the electrostatic latent image recorded on photoconductive surface 12 to development station C. At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 100, which permanently affixes the transferred toner powder image to the copy sheet. Fuser assembly 100 includes a heated fuser roller 46 and a back-up roller 48 with the powder image on the copy sheet contacting fuser roller 46. The pressure roller is cammed against the fuser roller to provide the necessary pressure to fix the toner powder image to the copy sheet. The fuser roll is internally heated by a quartz lamp.

After fusing, the copy sheets are fed to gate 50 which functions, as an inverter selector. Depending upon the position of gate 50, the copy sheets are deflected to sheet inverter 52 or are fed directly to a second decision gate 54. At gate 54, the sheet is in a faceup orientation with the image side, which has been fused, faceup. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roll 62, or onto a transport path to finishing station F. At finishing station F, copy sheets are stacked in a compiler tray and attached to one another to form sets. The sheets are attached to one another by either a binding device or a stapling device. In either case, a plurality of sets of documents are formed in finishing station F. When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station F.

Figure 1:
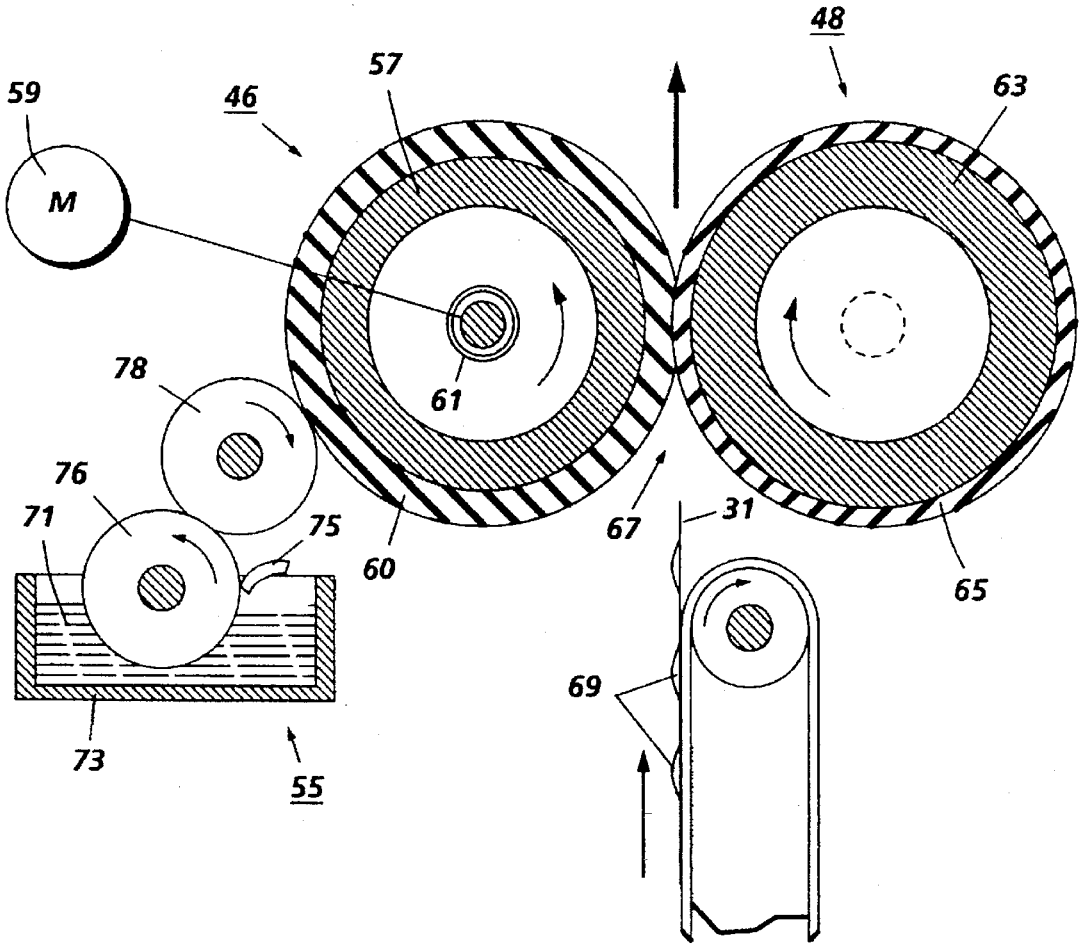
FIG. 1 PRIOR ART
FIG. 1 discloses a prior art heat and pressure fuser and release agent management system therefor.

Attention is now directed to FIG. 1 wherein the heat and pressure fuser apparatus comprising the fuser roller 46 and pressure roller 48 are illustrated together with a release agent management (RAM) system 55. As shown in FIG. 1, the fuser apparatus comprises the heated fuser roller 46 which comprises a core or body portion 57 having coated thereon a layer 60 of deformable elastomeric material such as silicone rubber or a non-deformable, low surface energy coating like Teflon™. Aluminum is preferred as the material for the core or body portion 57, although this is not critical. The core or body portion 57 is hollow and a heating element 61 is positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention. Thus, the fuser member can be heated by internal means, external means or a combination of both. Heating means are well known in the art for providing sufficient heat to fuse the toner to the support. The fusing surface layer may be fabricated using any well known material such as RTV and HTV silicone rubbers as well as Viton (trademark of E.I. dupont de Nemours & Co.) or Teflon™. A motor 59 serves to effect rotation of the fuser roll structure 46 for effecting movement of a copy sheet between the fuser roll and pressure.

The fuser roller 46 is shown in a pressure contact arrangement with the backup or pressure roller 48 (See FIG. 1). The pressure roller 48 comprises a metal core 63 with a layer 65 of a heat-resistant deformable material. In this assembly, both the fuser roller 46 and the pressure roller 48 are mounted on bearings which are mechanically biased in a conventional manner so that the fuser roller 46 and pressure roller 48 are pressed against each other under sufficient pressure to form a nip 67. It is in this nip that the fusing or fixing action takes place. The layer 65 may be fabricated from any well known deformable material such as fluorinated ethylene propylene copolymer or silicone rubber. The thickness of the layer 65 is less than the thickness of the layer 60 of the fuser roller in the case of a Nip Forming Fuser Roll (NFFR) as shown in FIG. 1 but would be greater in the case of a Nip Forming Pressure Roll (NFPR).

The image receiving member or final support 31 having toner images 69 thereon is moved through the nip 67 with the toner images contacting the heated fuser roller 46. The toner material forming the image 69 is prevented from offsetting to the surface of the fuser roller 46 by the application of a release agent material such as silicone oil 71 contained in sump 73.

The sump 73 and silicone oil 71 form part of the RAM system 55. The RAM system 55 comprises a metering roller 76 and a donor roll 78. The metering roller is supported partially immersed in the silicone oil 71 and contacts the donor roll for conveying silicone oil from the sump to the surface of the donor roll 78. The donor roll is rotatably supported in contact with the metering roller 76 and also in contact with the fuser roller 46. While the donor roll is illustrated as contacting the fuser roller, it will be appreciated that, alternately, it may contact the pressure roller 48. Also, the positions of the fuser and pressure rollers may be reversed for use in other copiers or printers. A metering blade 75 serves to meter silicone oil to the required thickness on the metering roller. For further details of the RAM system 55 reference may be had to U.S. Pat. No. 5,200,786 granted to Fromm et al on Apr. 6, 1993. Other known methods and apparatus for applying release agent material may be employed.

Figure 2:
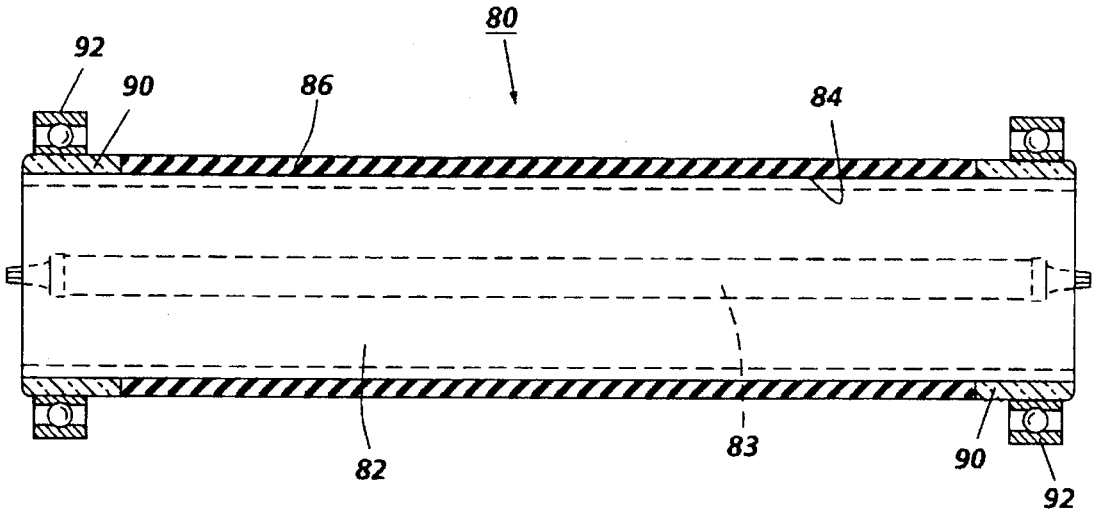
FIG. 2 illustrates a fuser roller, partially in cross section.

As shown in FIG. 2, a hubless fuser roll structure 80 comprises a core or body portion 82. The core has an outer surface 84 to which is adhered a layer of abhesive material 86 to which a release agent material is applied in a manner similar to that disclosed in connection description of FIG. 1. The core 82 is preferably fabricated from aluminum or stainless steel in the case of an instant-on, limited paper width fuser. The layer 86 may comprise a suitable elastomeric material such as RTV and HTV silicone rubbers as well as Viton (trademark of E.I. dupont de Nemours & Co.) or low surface energy coatings like Teflon™.

A pair of coatings or bands 90 is applied to the surface 84 adjacent the ends thereof. The coating or band is preferably effected by flame spraying a heat insulative ceramic material with subsequent machining of the coating or band in accordance with well known techniques. The coatings or bands serve as heat barriers between the core and the inner surface of a bearing structure 92. The thickness of the coatings or bands 90 is in the order of 1 to 3 mm. The coating may be applied in a thickness greater than 3 mm and then machined to the desired thickness.

It is believed that the foregoing description is sufficient for purposes of the present application to illustrate the general operation of an electrophotographic printing machine. Referring now to the specific subject matter of the present invention, FIGS. 3 through 5 depict features the present invention.

Figure 3:
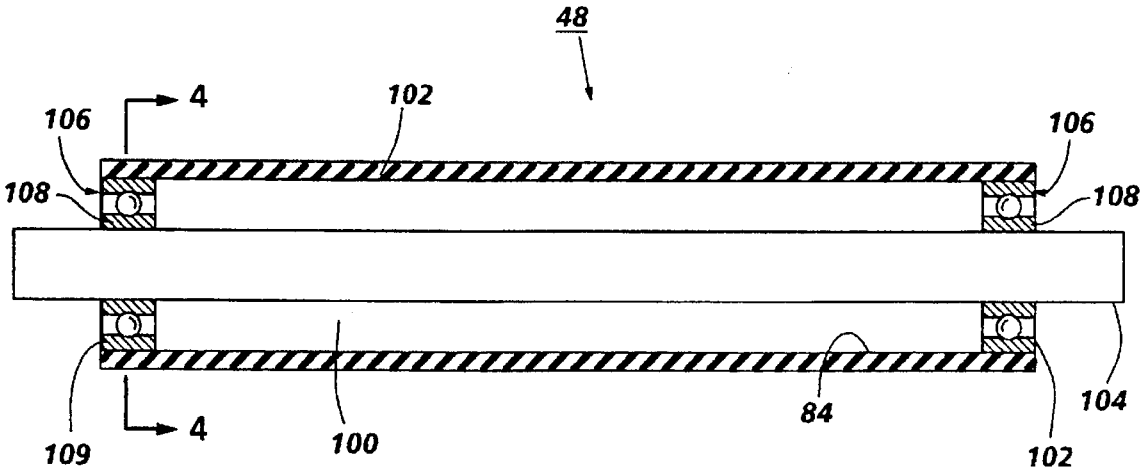
FIG. 3 depicts a pressure roll according to the invention.
Figure 4:
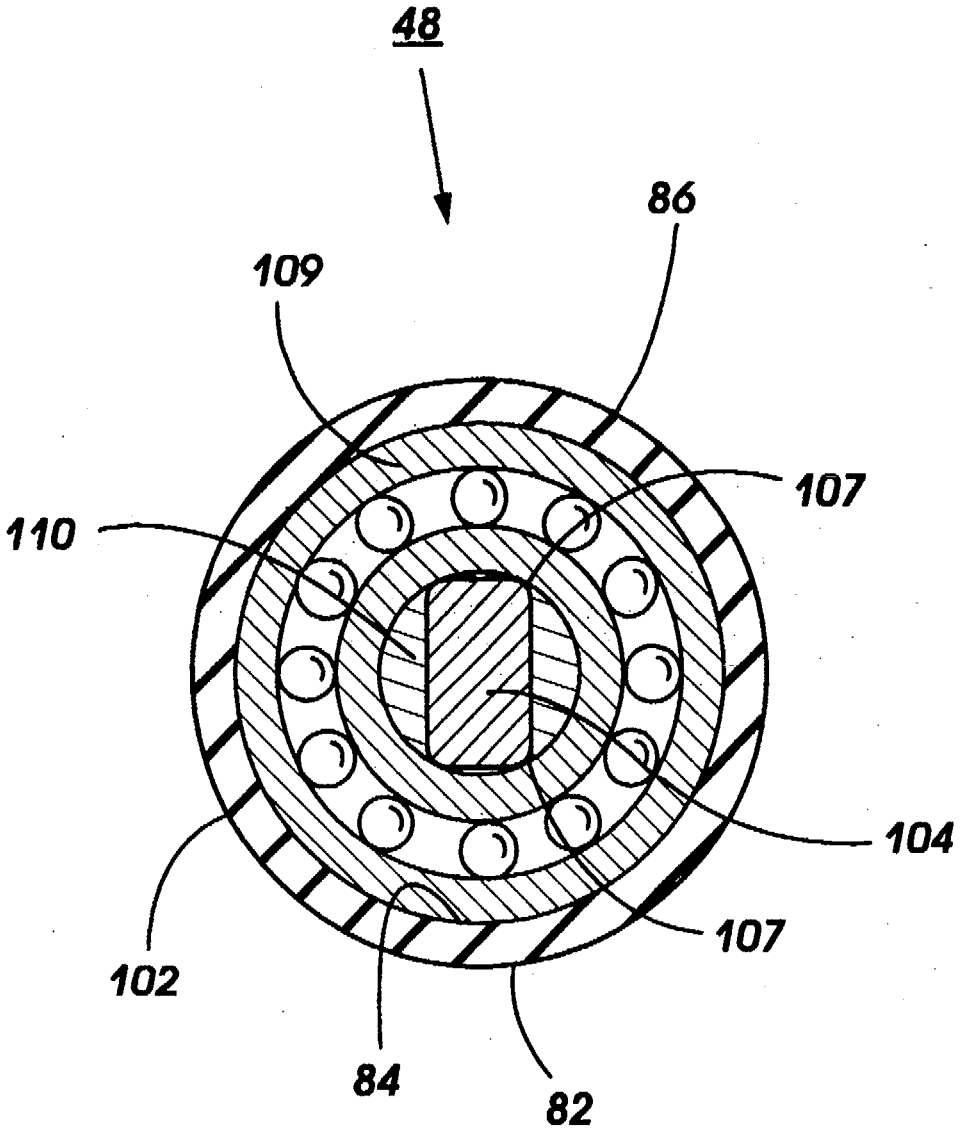
FIG. 4 is a cross-sectional view of the pressure roll of FIG. 3 taken along the line 4—4 of FIG. 3.

As disclosed in FIG. 3, the pressure roll 48 comprises a core 100 having an outer deformable layer 102 adhered thereto. A pair of bearings 106 are installed in the end of the core 100. Each bearing comprises an inner race 108 and an outer race 109. A non-rotating, flat shaft 104 is received in the inner races 108 of the bearings 106. The shaft 104 has a rectangular cross section as viewed in FIG. 4. The flat shaft when installed in the bearings is aligned with the loading vector of the roll pair comprising the fuser and pressure rolls. In other words, the shaft is oriented such that it occupies a generally vertical orientation.

The shaft is rectangular in cross-sectional with a height of 17 mm and a width of 3 mm. The shaft is fabricated by stamping it from a preplated piece of flat shaft stock. The ends of the shaft are fixedly mounted in the inner races 108 of the bearing structures 106 in accordance with well known manufacturing procedures. At places where the shaft ends contact the inner race, a coining or fine blanking procedure is employed. While the ends of the flat shaft after the stamping process have approximately a rectangular cross section the bearing zones (defined as the area of shafts that contact the inner race 108) may be turned, if required, to provide a rounded profile with a tight tolerance. The coining operation could also provide a cross section that is round or approximately round with facets. This would represent the lowest cost case. Alternatively, plastic wedges 110 (FIG. 4) may be provided for certain applications of the pressure roll of the present invention. Such wedges are installed between both sides of the shaft and the bearing.

What is claimed is:

1. A fuser structure for fixing toner images to an image receiving surface, said structure comprising:

a fuser roll;

a pressure roll pressure engageable with said fuser roll;

said pressure roll comprising:

a core structure;

an abhesive layer secured to said core structure;

a plurality of bearings for operatively supporting said fuser structure in an imaging device; and a flat shaft having a substantially rectangular cross section and received in said bearings, said cross section being about 3 by 17 mm and having bearing zones which are fine blanked, coined or turned.

2. Apparatus according to claim 1 further including a pair of wedges inserted between said larger dimension of said flat shaft and said bearings for centralizing said shaft in said bearings.

3. A pressure roll structure for use in a heat and pressure roll fuser, said pressure roll comprising:

a core structure;

an abhesive layer secured to said core structure;

a plurality of bearings for operatively supporting said fuser structure in an imaging device; and a flat shaft having a substantially rectangular cross section and received in said bearings, said cross section being about 3 by 17 mm and having bearing zones which are fine blanked, coined or turned.

4. Apparatus according to claim 3 further including a pair of wedge members inserted between the larger dimension of said flat shaft and said bearings for centralizing said shaft in said bearings.

* * * * *